US005906050A

United States Patent [19]

Gilbert

[11] Patent Number: 5,906,050

[45] Date of Patent: May 25, 1999

[54] UTILITY KNIFE

[75] Inventor: Richard Gilbert, Dronfield, United Kingdom

[73] Assignee: The Stanley Works Limited, Sheffield, United Kingdom

[21] Appl. No.: 08/984,300

[22] Filed: Dec. 3, 1997

[30] Foreign Application Priority Data

Dec. 4, 1996 [GB] United Kingdom ..... 9625260

[51] Int. Cl.[6] ..... B26B 1/08

[52] U.S. Cl. ..... 30/162; 30/335

[58] Field of Search ..... 30/151, 162, 329, 30/335

[56] References Cited

U.S. PATENT DOCUMENTS

| | | | |
|---|---|---|---|
| 2,548,797 | 4/1951 | Ingwer et al. | 30/162 |
| 2,862,296 | 12/1958 | Anderson | 30/162 |
| 4,068,375 | 1/1978 | Rathbun et al. | 30/125 |
| 4,240,202 | 12/1980 | Gilbert | 30/162 |
| 4,322,885 | 4/1982 | Osada | 30/162 |
| 4,936,014 | 6/1990 | Shaanan et al. | 30/162 |
| 5,005,290 | 4/1991 | Gilbert | 30/162 |
| 5,025,558 | 6/1991 | Gilbert | 30/162 |
| 5,042,154 | 8/1991 | Gilbert | 30/162 |
| 5,121,544 | 6/1992 | Gilbert | 30/162 |
| 5,269,063 | 12/1993 | Okada | 30/162 |
| 5,502,896 | 4/1996 | Chen | 30/162 |

FOREIGN PATENT DOCUMENTS 2 300 376 11/1996 United Kingdom .

*Primary Examiner*—Hwei-Siu Payer
*Attorney, Agent, or Firm*—Alix, Yale & Ristas, LLP

[57] ABSTRACT

A hand held utility knife (20) is provided internally with a rectilinear guidance track (42) for the cutting blade (28), while the operating button (38) for advancing and retracting the blade (28) is guided in a curved slot (40). The mechanism (36) for advancing and retracting the blade (28) comprises a member (44) with a spigot (46) at the front end of member (44) and the operating button (38) at the rear end of member (44), which pivots on the spigot (46) relative to the blade (28). The spigot (46) is rectilinearly guided by internal ribs (64, 66) within the handle (22), independently of the rectilinear track (42) for guiding the blade (28).

6 Claims, 7 Drawing Sheets

35
24

24

40
24

60
60

UTILITY KNIFE

FIELD OF THE INVENTION

This invention relates to a utility knife having a retractable blade.

PRIOR ART

Utility knives having retractable blades are well known. One such known utility knife comprises an elongate handle; a cutting blade; and a blade-controlling mechanism; the handle being formed with a rectilinear track along which the cutting blade is rectilinearly guided, so that the blade can be selectively advanced within the handle along the track, in a forward direction to a forward, operative position, where the blade protrudes from a front end of the handle, and so that the blade can be selectively retracted along the track, in a rearward direction to a rearward position, where the blade is stored inside the handle; the mechanism comprising a unitary carrier which slides rectilinearly within the handle, a first portion of the carrier engaging the blade, for advancing and retracting the blade along the track; a manually engageable second portion of the carrier projecting from the inside to the outside of the handle through a rectilinear slot in one side of the handle, parallel to the track, so that movement of said second portion in the forward direction along the slot causes advancement of the blade, and so that movement of said second portion in the rearward direction along the slot causes retraction of the blade; co-operative parts of the handle and the carrier forming a detent mechanism for selectively holding the blade in at least the forward operative position and the rearward position.

Because the track for the blade is rectilinear, the slot in the side of the handle has to be rectilinear, and has to be parallel to the track.

Prior art includes British patent specification No. GB 2 300 376 A (Fiskars) and U.S. Pat. No. 4,936,014 (Johnson).

SUMMARY OF THE INVENTION

It is an object of the invention to provide a utility knife in which the slot in the handle is not parallel everywhere along the slot to the track for the blade. The slot may be curved, or part-curved and part-straight, or simply straight but not parallel to the track. The curvature of the slot, if present, may be simple or complex.

According to the invention, there is provided a utility knife comprising:

a handle; a cutting blade; and a blade-controlling mechanism;

the handle being formed with a rectilinear, first track, along which the cutting blade is rectilinearly guided, so that the blade can be selectively advanced within the handle along the track, in a forward direction to a forward, operative position, where the blade protrudes from a front end of the handle, and so that the blade can be selectively retracted along the track, in a rearward direction to a rearward position, where the blade is stored inside the handle;

the mechanism comprising a member, a first portion of the member pivotally engaging a hole in the blade, and a manually engageable second portion of the member projecting from the inside of the handle to the outside of the handle through a slot in the handle, at least part of the slot extending in a direction which is not parallel to the rectilinear direction of said track; said second portion being spaced apart from said first portion of the member; the member extending forwardly from said second portion to said first portion, the member pivoting relative to the blade as the blade is advanced and retracted for advancing and retracting the blade along the track; so that movement of said second portion in one direction along the slot causes advancement of the blade, and so that movement of said second portion in the opposite direction along the slot causes retraction of the blade;

co-operative parts of the handle and the mechanism forming a detent mechanism for selectively holding the blade in at least the forward operative position and the rearward position.

Preferably, the slot is a side slot, a "side slot" being defined as a slot which faces to one side of the handle—as distinct from facing upwardly, downwardly, forwardly or rearwardly—when the knife is oriented with the blade in a vertical plane and with a cutting, bottom edge of the blade substantially horizontal.

Preferably at least a portion of the slot diverges from the track in a rearward direction.

The slot may be curved.

The divergence of said portion of the slot from the track preferably increases progressively in the rearward direction.

Preferably said first portion of the member is rectilinearly guided by the handle independently of the guidance of the blade.

Further features and advantages of the invention will become apparent from the following description of an embodiment of the invention with reference to the drawings.

DETAILED DESCRIPTION OF PREFERRED EMBODIMENT

Figure 2:
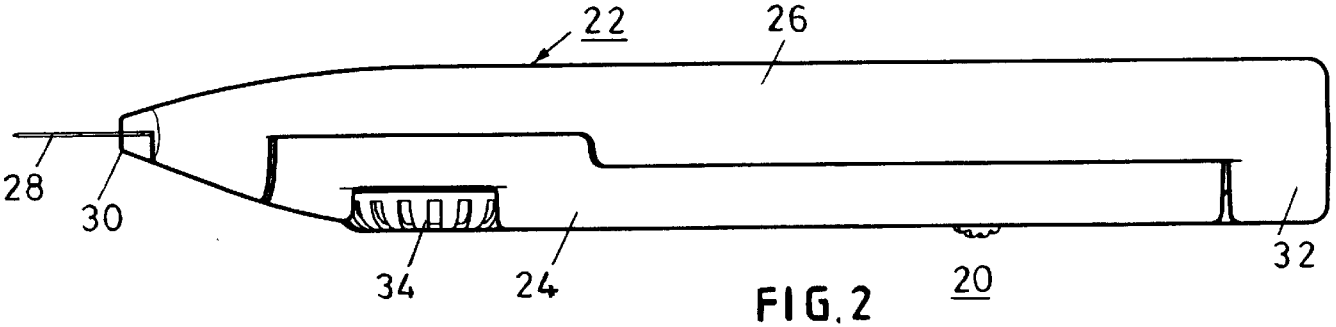
FIG. 2 is a plan view of the utility knife of FIG. 1.

Referring to the drawings, which illustrate a hand-held utility knife 20 embodying the invention, the utility knife 20 comprises a handle 22 which is in two halves 24 and 26. The utility knife 20 also comprises a cutting blade 28 of well known type, provided with a series of score lines 29 for breaking off successive used portions of the blade as they become blunt. The blade 28 can be advanced for use so as to project from a front end 30 of the handle 22, as shown in FIGS. 1 and 2.

The two handle halves 24 and 26 are hinged together at the rear end 32 of the handle 22 in the same way as the handle halves of a utility knife which is described and illustrated in detail in British patent application No. 9604748.5 entitled "Hand-held Utility Knife".

Figures 13, 14, 14A:
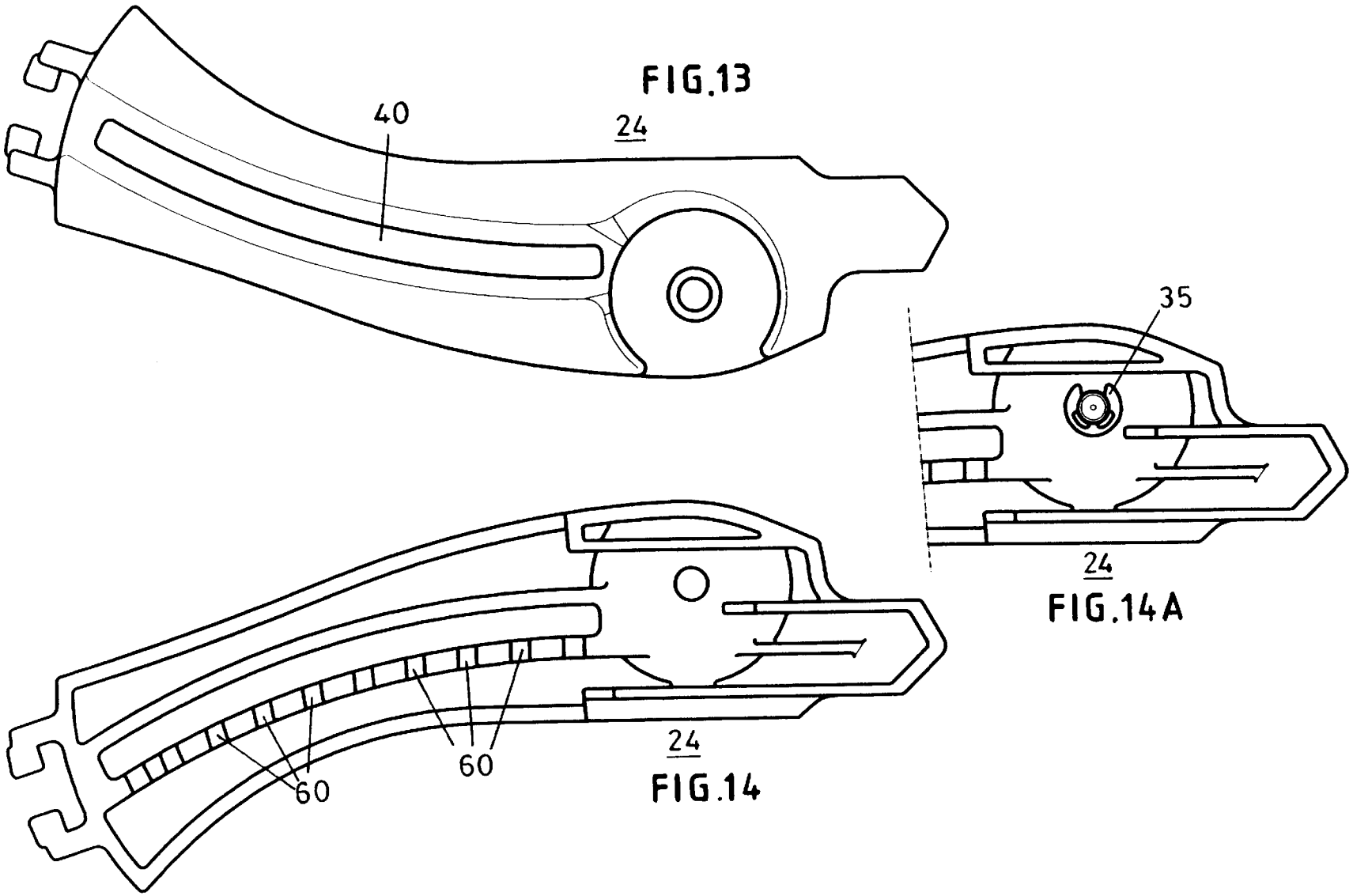
FIGS. 13 and 14 are opposite side elevations of the other handle half.
FIG. 14A corresponds to FIG. 14 but shows a clamping screw held by a circlip.

A large-headed clamping screw 34 is provided near the front end 30—in a similar manner to the clamping screw of the utility knife described and illustrated in the above-mentioned British patent application No. 9604748.5—for selectively clamping the handle halves 24 and 26 together, so that the blade 28 is clamped tightly between them for use. The clamping screw 34 is fitted with a circlip 35 to prevent its detachment from the handle half 24 (FIG. 14A).

Figure 1:
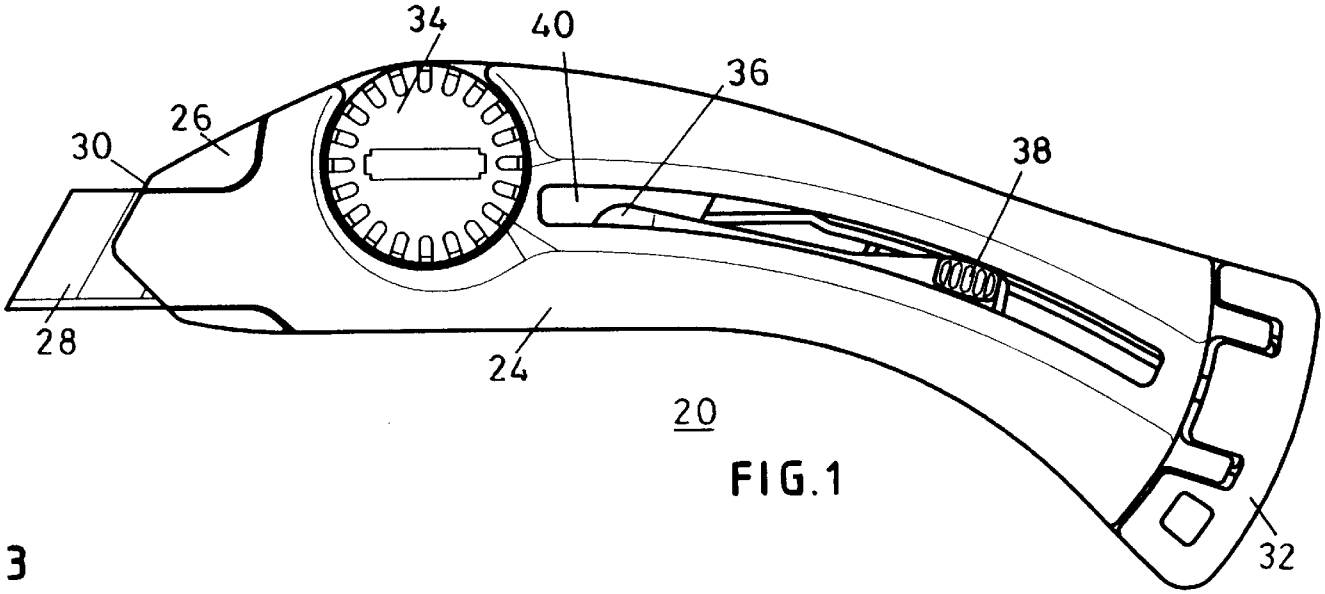
FIG. 1 is a front elevation of a utility knife embodying the invention.
Figure 3:
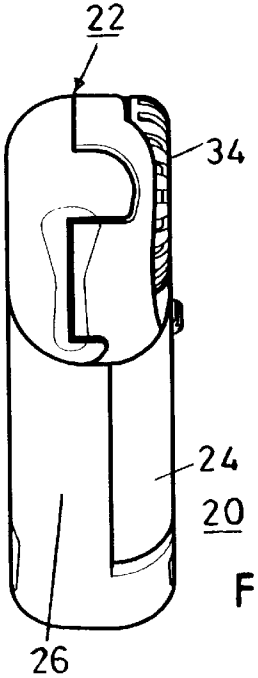
FIG. 3 is a front end view of the utility knife of FIG. 1.
Figure 6:
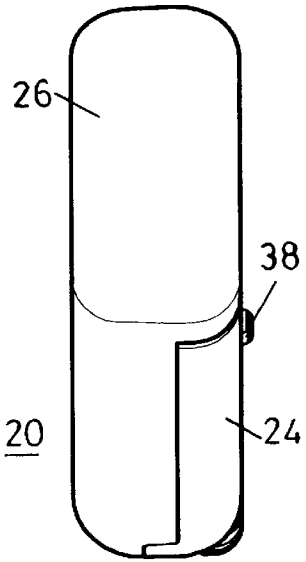
FIG. 6 is a rear end view of the utility knife of FIG. 1.
Figure 4:
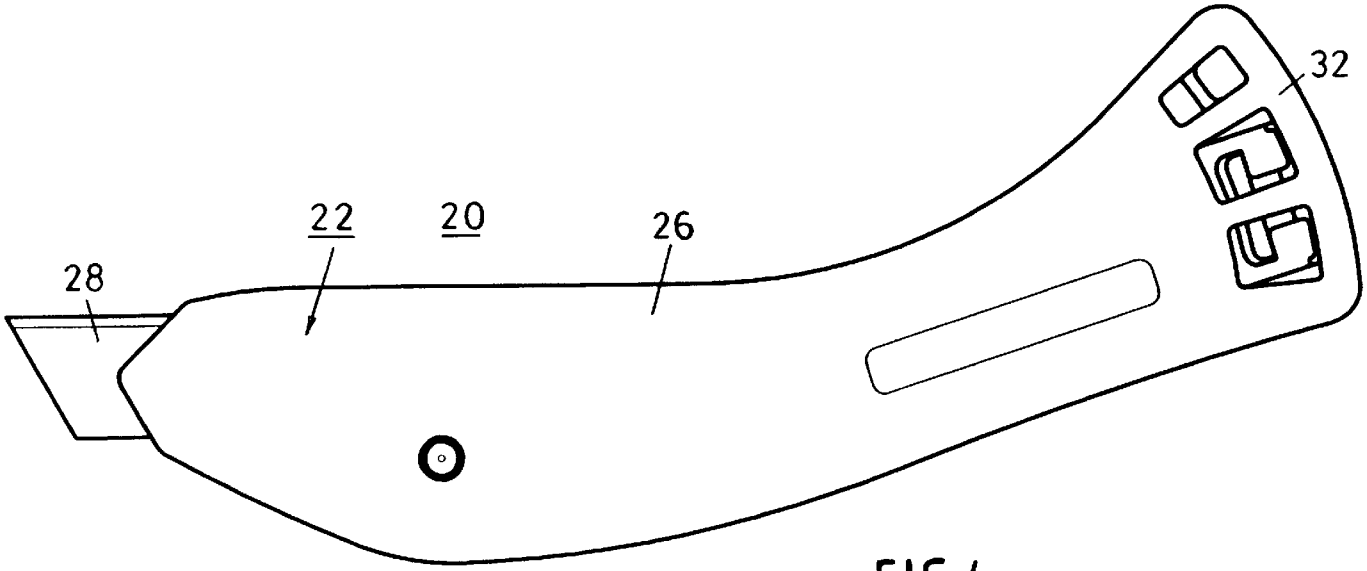
FIG. 4 is an inverted rear elevation of the utility knife of FIG. 1.
Figure 5:
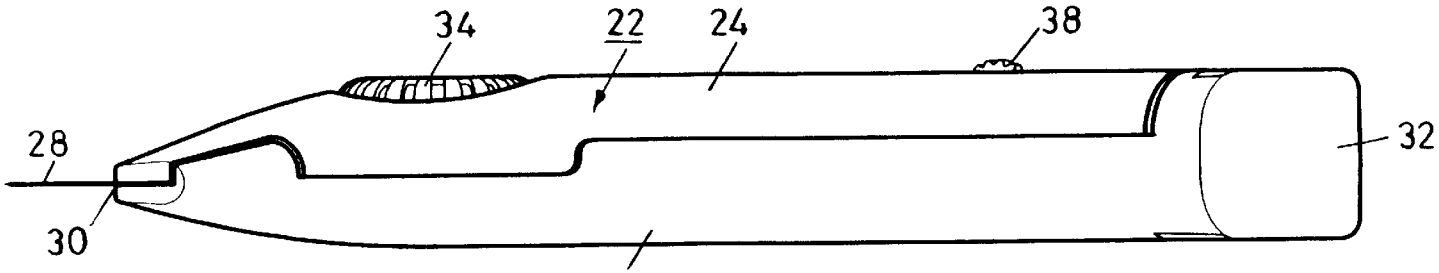
FIG. 5 is an underneath plan view of the utility knife of FIG. 1.

The mechanism 36 for advancing and retracting the blade 28 comprises a button 38 which projects as shown in FIG. 1 through a curved slot 40. The slot 40 is a side slot, facing to one side of the handle 22 as shown in FIG. 1 when the knife 20 is oriented as shown in FIG. 1 with the blade 28 in a vertical plane and with the conventional cutting, bottom edge of the blade 28 substantially horizontal.

Figure 7:
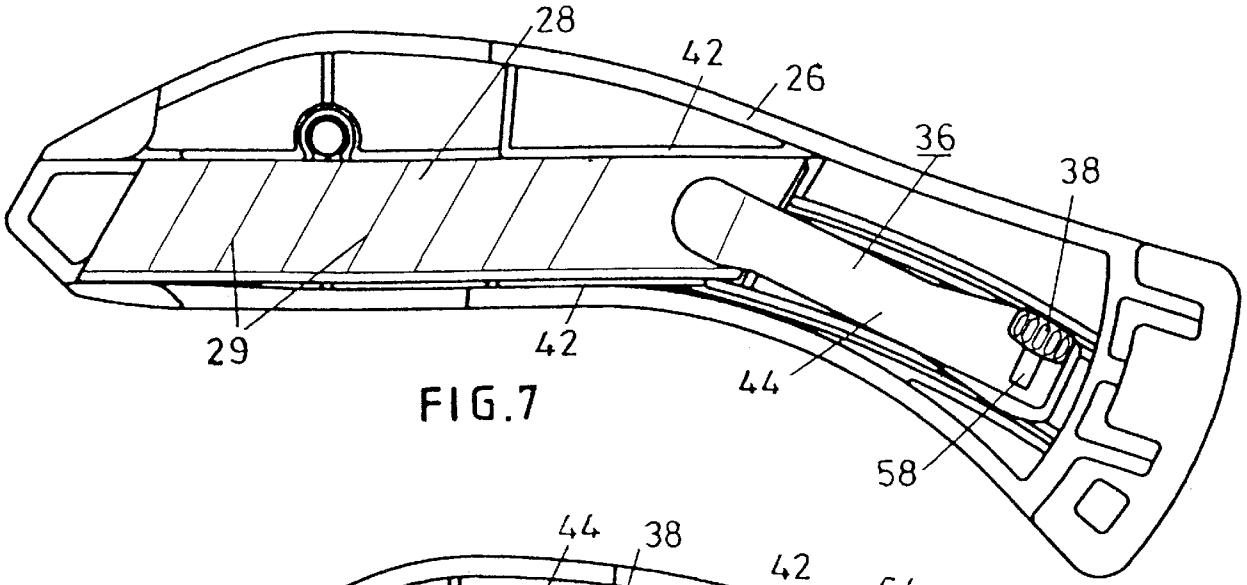
FIG. 7 is a view corresponding to FIG. 1 but with one handle half removed and showing the blade in its storage position.
Figure 10A:
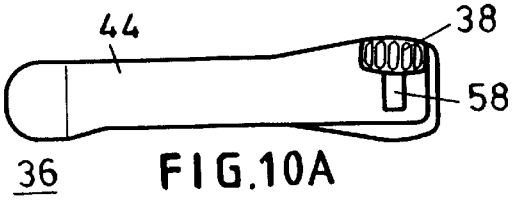
FIGS. 10A, 10B and 10C are a front view, side view and rear view respectively of a mechanism for advancing and retracting the blade, in the utility knife of FIG. 1.
Figure 10E:
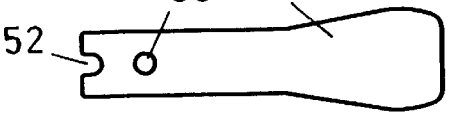
FIG. 10E is an elevational view of a spring blade of the mechanism of FIGS. 10A, 10B and 10C.
Figure 10F:
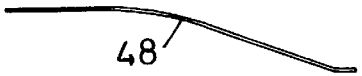
FIG. 10F is a side view corresponding to FIG. 10E.
Figure 10B:
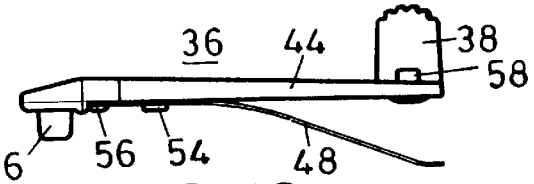
Figure 10C:
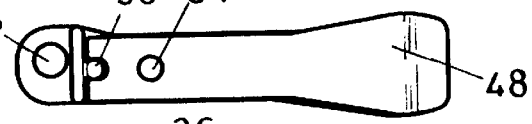
Figure 10D:
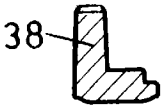
FIG. 10D is a sectioned view of part of the mechanism of FIGS. 10A, 10B and 10C.
Figure 11:
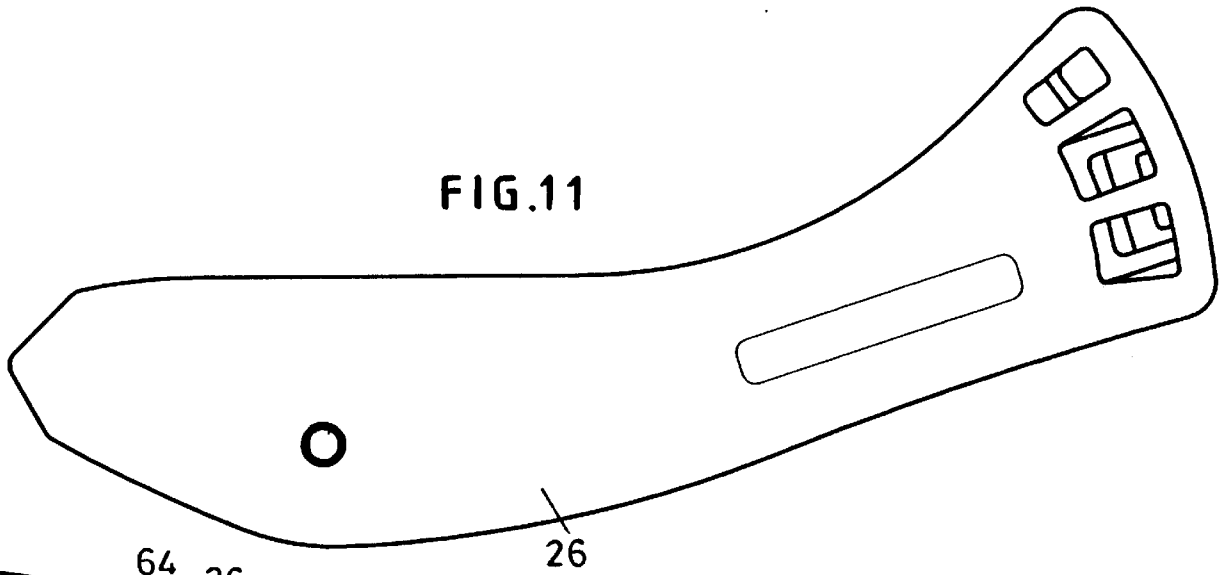
FIGS. 11 and 12 are opposite side elevations of one handle half of the utility knife of FIG. 1.
Figure 12:
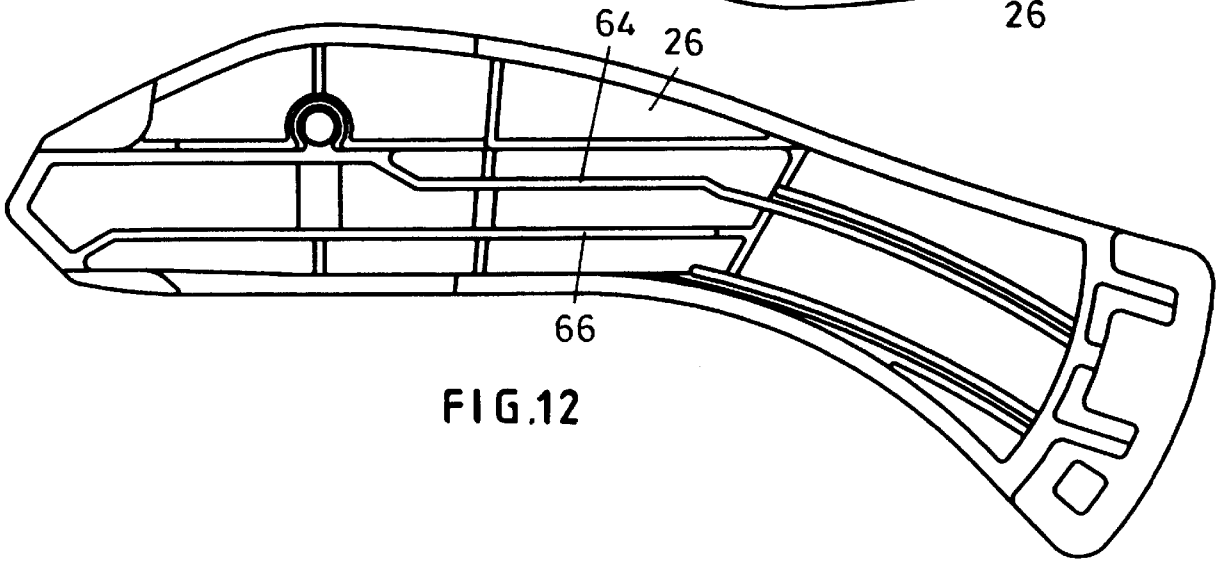

Referring to FIG. 7, the blade 28 is guided along a rectilinear, or straight, guide track 42 for advancement and retraction within the handle 22. The mechanism 36 for advancing and retracting the blade 28 comprises a member 44 (see FIGS. 10A to 10D) of which the button 38 is an integral part, the button 38 being located at a rear end of member 44. The member 44 extends forwardly from the button 38 to an integral spigot 46 (FIG. 10B) at the front end of member 44. A leaf spring 48 (FIGS. 10E and 10F) is provided with an aperture 50 and a recess 52, whereby the leaf spring 48 is attached in well known manner to the member 44, which is provided with two projections 54, 56 engaging the aperture 50 and recess 52 respectively as shown in FIGS. 10B and 10C.

Figure 9:
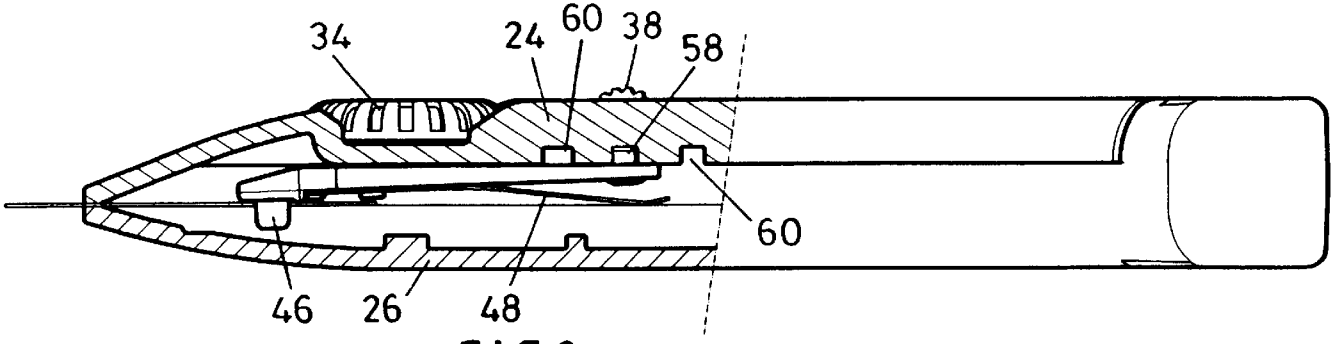
FIG. 9 is a view corresponding to FIG. 5 but partly sectioned to show the detent mechanism.

The member 44 is formed at its rear end with a detent 58 which is biased by the leaf spring 48 as shown in FIG. 9 into engagement with any selected one of a number of detent recesses 60 for positioning the mechanism 36 in any selected position along the handle 22. The leaf spring 48 bears against ribs 61, 63, 64, 66 in the handle half 26.

Figure 8:
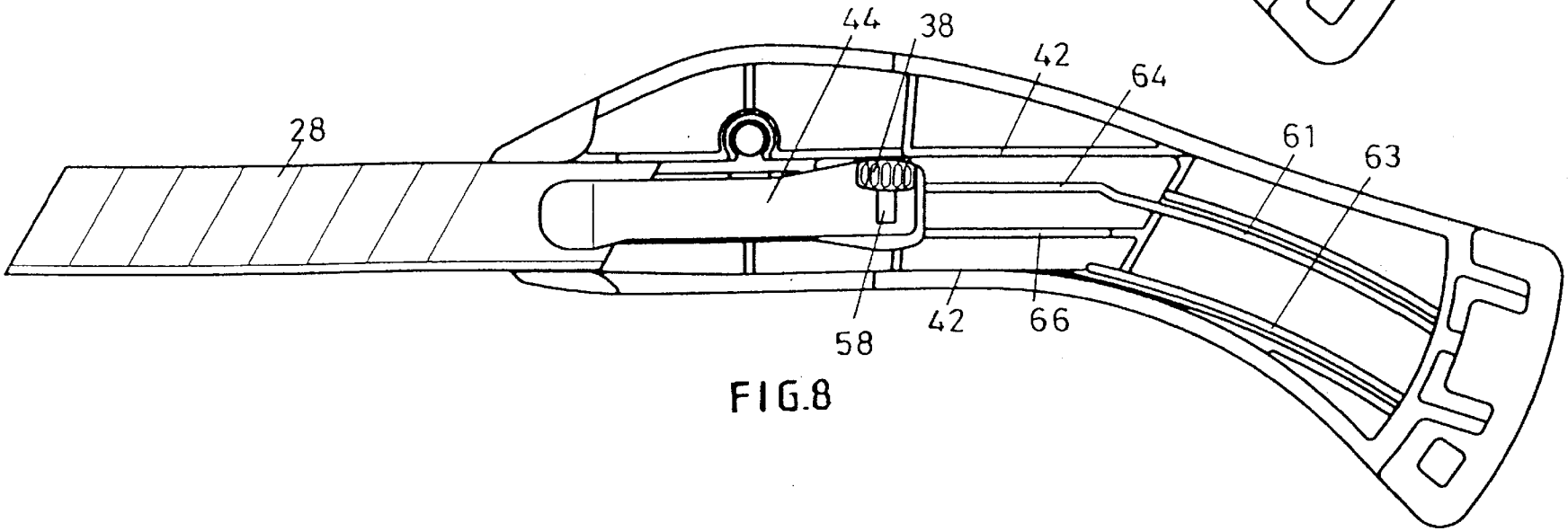
FIG. 8 corresponds to FIG. 7 but shows the blade fully extended.
Figure 15:
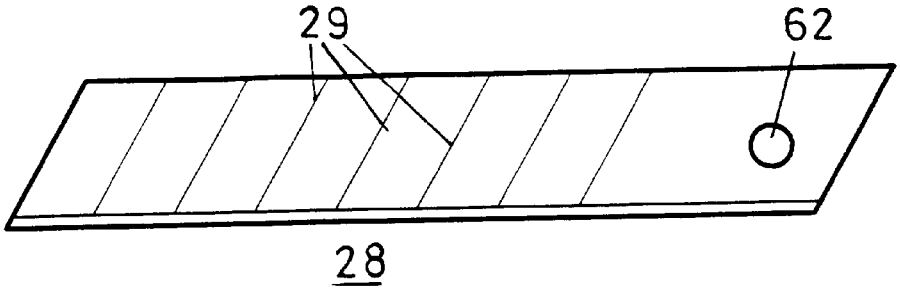
FIG. 15 illustrates a blade in the utility knife of FIG. 1.
Figure 16:
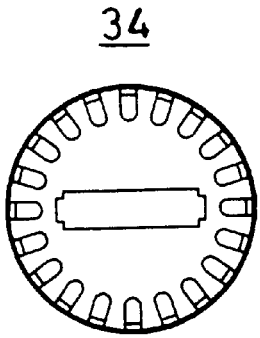
FIGS 16, 17 and 18 are a front elevation, a side elevation and a sectioned view of a large-head clamping screw in the utility knife of FIG. 1.
Figure 17:
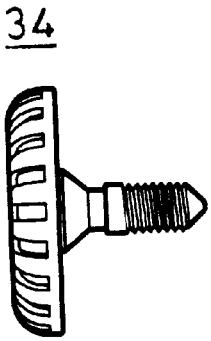
Figure 18:
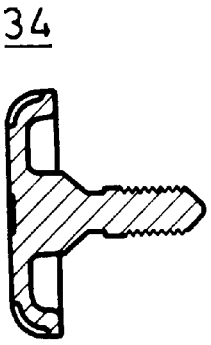
Figure 19A:
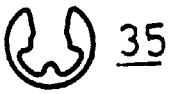
FIGS. 19A and 19B are mutually orthogonal views of a circlip.
Figure 19B:
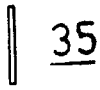

The spigot 46, which is of circular cross section, engages in a round hole 62 (FIG. 15) at the rear end of the blade 28, so that member 44 can pivot relative to the blade 28 with the spigot 46 and the hole 62 defining the pivotal axis. As mentioned above, the slot 40 is curved. More particularly, the front end of the slot 40 is almost parallel to the blade 28, whereas the rear end of the slot 40 diverges progressively away from the blade 28, as should be apparent from a study from FIG. 1. When the blade 28 is fully advanced, as shown in FIG. 8, so that the member 44 is in its most forward position, the member 44 is virtually parallel to the blade 28. However, when the blade 28 is fully retracted inside the handle 22, as shown in FIG. 7, the member 44 has pivoted about the spigot 46 to a position in which the member 44 forms an angle with the blade 28.

In order to prevent the member 44 from pulling downwardly on the rear end of the blade 28 as the latter is retracted rearwardly into the handle 22, the spigot 46 is guided rectilinearly, and parallel to the blade 28, between two parallel ribs 64, 66, independently of the rectilinear track 42 for the blade 28. A guide surface on the rib 66 supports the spigot 46, to provide firm location for the rear end of the blade 28 when, in use, cutting forces tend to displace the blade 28 relative to the handle 22. The spigot 46 bears against the guide surface of the rib 66 when cutting forces on the edge of the blade 28 tend to pivot the blade 28 in the handle 22, particularly when the member 44 is in its frontmost position.

An angular relationship exists between the longitudinal axis of the blade 28, on the one hand, and a straight line between the button 38 and the spigot 46 on the other hand, such that, at positions of the blade 28 close to its rearmost position, rearward movement of the button 38 along the slot 40 will tend to pull on the blade 28 at an angle to the longitudinal axis of the blade 28 and will cause a sharpened bottom-rear-end of the blade 28 to dig into the blade track. So as to prevent this blade interference, which would inhibit free movement of the blade 28 and would cause damage to its edge, a longitudinal guide surface is provided, lying parallel to the blade 28, on the rib 66. The spigot 46 runs on this guide surface, which ensures parallel movement of the spigot 46, which in turn guides the rear end of the blade 28.

Preferably the guide surface on the rib 66 functions also in providing a surface for the slider spigot 46 to bear upon when cutting forces on the blade edge tend to pivot the blade 28 in the knife handle, particularly when the blade 28 is in its frontmost position.

By virtue of the pivoted member 44, which enables the slot 40 to be curved, it is possible for the handle 22 to be curved as shown, making the handle 22 comfortable to hold, whilst maintaining the rectilinear or straight guidance for the cutting blade 28. Furthermore, the button 38 is welded to the rear of the hole 62 at the rear end of the blade 28, leaving plenty of room for the large-headed clamping screw 34 near the front end 30 of the handle 22.

Although the blade 28 is of the "snap-off" type, with score lines 29, it may be substituted by the well known trapezoidal one-piece blade (not shown), provided that the trapezoidal blade has one or more holes like the hole 62, for engagement by the spigot 46.

I claim:

1. A utility knife comprising:

a hollow handle; a cutting blade; and a blade-controlling mechanism;

the handle being formed internally with a rectilinear, first track, along which the cutting blade is rectilinearly guided, so that the blade can be selectively advanced within the handle along the track, in a forward direction to a forward, operative position, where the blade protrudes from an opening at a front end of the handle, and so that the blade can be selectively retracted along the track, in a rearward direction to a rearward position, where the blade is stored inside the handle; the handle being formed with a slot;

the blade being formed with a hole;

the mechanism comprising a member, a first portion of the member pivotally engaging the hole in the blade, and a manually engageable second portion of the member projecting from the inside of the handle to the outside of the handle through the slot in the handle, at least part of the slot extending in a direction which is not parallel to the rectilinear direction of said track; said second portion being spaced apart from said first portion of the member; the member extending forwardly from said second portion to said first portion, the member pivoting relative to the blade as the blade is advanced and retracted for advancing and retracting the blade along the track; so that movement of said second portion in one direction along the slot causes advancement of the blade, and so that movement of said second portion in the opposite direction along the slot causes retraction of the blade;

co-operative parts of the handle and the mechanism forming a detent mechanism for selectively holding the blade in at least the forward operative position and the rearward position.

2. A knife as claimed in claim 1, wherein said slot is a side slot, facing to one side of the handle when the knife is oriented with the blade in a vertical plane and with a cutting, bottom edge of the blade substantially horizontal.

3. A knife as claimed in claim 2, wherein at least a portion of the slot diverges from the track in a rearward direction.

4. A knife as claimed in claim 2 wherein the slot is curved.

5. A knife as claimed in claim 4, wherein a portion of the slot diverges in the rearward direction from the track, the divergence increasing progressively in the rearward direction.

6. A knife as claimed in claim 1, wherein said handle further comprises means for rectilinearly guiding said first portion of the member independently of the guidance of the blade.

* * * * *